United States Patent [19]

Donnelly

[11] Patent Number: 4,457,326

[45] Date of Patent: Jul. 3, 1984

[54] SYSTEM FOR PROVIDING TEMPORARY WATER SERVICE BETWEEN A WATER MAIN AND ONE OR MORE LOCATIONS NORMALLY CONNECTED TO THE MAIN

[75] Inventor: Frank Donnelly, Rockaway, N.J.

[73] Assignee: Spiniello Construction Company, Morristown, N.J.

[21] Appl. No.: 301,430

[22] Filed: Sep. 11, 1981

[51] Int. Cl.[3] ..... E03B 7/12; F16L 53/00

[52] U.S. Cl. ..... 137/59; 126/420; 137/564; 137/565; 138/32; 165/40; 237/80; 417/2; 417/32

[58] Field of Search ..... 137/59, 62, 563, 564, 137/570, 565; 126/420, 432; 138/32, 34; 165/40; 237/80; 417/2, 32

[56] References Cited

U.S. PATENT DOCUMENTS

| | | | |
|---|---|---|---|
| 508,132 | 11/1893 | Gold | 237/80 |
| 740,462 | 10/1903 | Parker | 237/80 |
| 758,436 | 4/1904 | Gold | 237/80 |
| 2,181,436 | 11/1939 | Madden | 237/80 |
| 2,220,078 | 11/1940 | Cornell, Jr. | 137/564 |
| 2,351,544 | 6/1944 | Revard | 138/32 |
| 2,650,180 | 8/1953 | Walker | 138/32 |
| 3,420,252 | 1/1969 | Stroble | 137/59 |
| 3,929,153 | 12/1975 | Hasty | 137/564 |

*Primary Examiner*—George L. Walton
*Attorney, Agent, or Firm*—Marvin A. Naigur

[57] ABSTRACT

A system for providing temporary water service between a water main and one or more locations normally connected to the main in which a pipeline is provided above ground and has a supply section and a return section which are connected to the main. Each of the locations are connected between the supply section and the return section. The water is circulated from said supply section, through said location and to said return section in response to the ambient temperature dropping below a predetermined value.

8 Claims, 2 Drawing Figures

SYSTEM FOR PROVIDING TEMPORARY WATER SERVICE BETWEEN A WATER MAIN AND ONE OR MORE LOCATIONS NORMALLY CONNECTED TO THE MAIN

BACKGROUND OF THE INVENTION

This invention relates to a temporary water main system and more particularly to a system for providing temporary water surface between a water main and one or more locations normally connected to the main.

In order to clean or repair an underground water main it is necessary to cut off the flow of water at each end of the portion of the main that is being worked. In these arrangements, after the main has been cut off, a temporary bypass main is usually added which consists of an overground pipeline system that is connected to a fire hydrant to provide temporary service to the locations normally secured by the bypassed main portion. However, in cold weather the water in these overground pipes will freeze at low temperature, particularly at night when there is little or no use of the water and consequently no flow in the pipes. The freezing, of course, often causes damage to the pipes.

SUMMARY OF THE INVENTION

It is therefore an object of the present invention to provide a system for providing temporary water surface service between a water main and one or more locations normally connected to the main which eliminates the danger of water freezing in the pipes.

It is a further object of the present invention to provide a system of the above type which enables a temporary overground piping system to be used without the danger of water freezing.

It is a still further object of the present invention to provide a system of the above type in which water is continuously circulated between each location being serviced and the temporary overground pipeline system.

It is a still further object of the present invention to provide a system of the above type in which thermostatic means are provided which responds to the water temperature dropping below a predetermined value for circulating the water through the temporary overground pipeline and the pipes connected to the locations.

Toward the fulfillment of these and other objects, the system of the present invention includes a pipeline located above ground and having a supply section and a return section connected to the main. Each of the locations being served are connected between the supply section and the return section and water is circulated from the supply section through the location and to the return section in response to the water temperature falling below a predetermined value.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
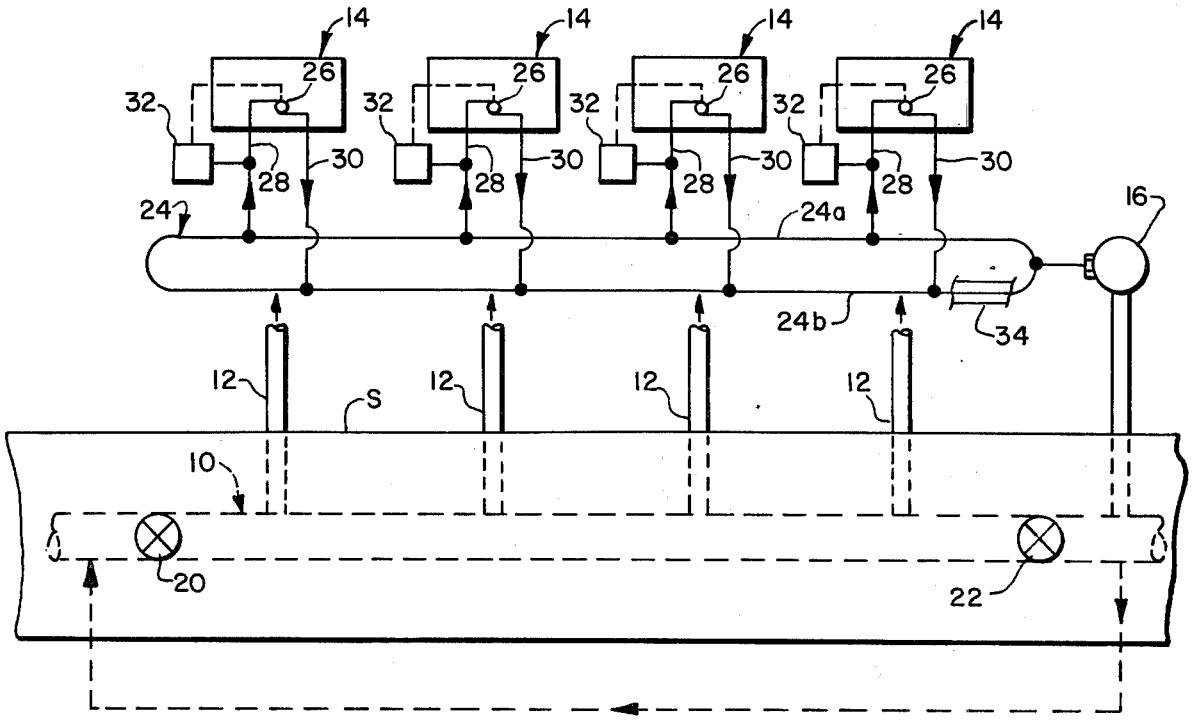
FIG. 1 is a schematic view depicting the system of the present invention.

Referring specifically to FIG. 1, the reference numeral 10 refers in general to a municipal water main, a portion of which is shown for the convenience of presentation extending below a municipal street, or the like, shown by the letter S. A plurality of horizontally extending branch pipes 12 extend from the main 10 to a plurality of individual locations, shown in general by the reference numeral 14, which represent homes, buildings, or the like which are serviced by the main 10. For the convenience of presentation the complete length of each pipe 12 has not been shown. A hydrant 16 is provided which is connected to the main by a pipe 18 and which is adapted to function in conventional manner to provide water from a location above ground. In the normal operation of this system just described, water from the main 10 will be supplied to each location 14 on an as-needed basis through the branch pipes 12.

In the event the underground water main 10 needs to be cleaned due to the accumulation of various deposits in the pipe which impedes the water flow therethrough, or otherwise becomes inoperable, a section of the pipe is cut off by two valve members shown in general by the reference numerals 20 and 22 at a predetermined spaced-apart location along the main. In accordance with conventional practice a single overground pipeline would be then connected from the hydrant 16 to the branch lines 12 at a location above ground to provide temporary water service. However, as mentioned above, the water in this type of arrangement is highly susceptible to freezing when the ambient temperature drops below a predetermined value.

According to the present invention, a temporary overground pipeline, shown in general by the reference numeral 24, is provided which is in the form of a continuation loop including a supply section **24*a* and a return section 24*b*** which extends parallel to the supply section.

A pump 26, located within or adjacent to each location 16, is connected to the supply section **24*a* by a pipe 28 and to the return section 24*b* by a pipe 30. As a result, water can flow from the supply section 24*a* through one or more pipes 28 and their respective locations 14, and then back to their respective return lines 24*b* via the pipes 30. A thermostat, shown in general by the reference numeral 32, is associated with each location, is connected between the pipe 28 and the pump 26, and is responsive to the temperature of the water in the pipe falling below a predetermined value for actuating the pump 26** and thus causing water to flow in the manner just described. Due to the movement of the water around the loop and the friction of water moving in the loop, the freezing level in the system will be reduced to a value well below zero degrees centigrade.

An insulation, shown in general by the reference numeral 34 and only partially for the convenience of presentation, can be provided around the pipeline 24 to further insulate it from the extreme temperatures. Also, an external heating mechanism (not shown) can be provided for keeping the temperature of the pipeline 24 at an elevated temperature.

Thus the problems discussed above normally associated with the cleaning of a portion of the water main 10 are avoided according to the present invention.

Figure 2:
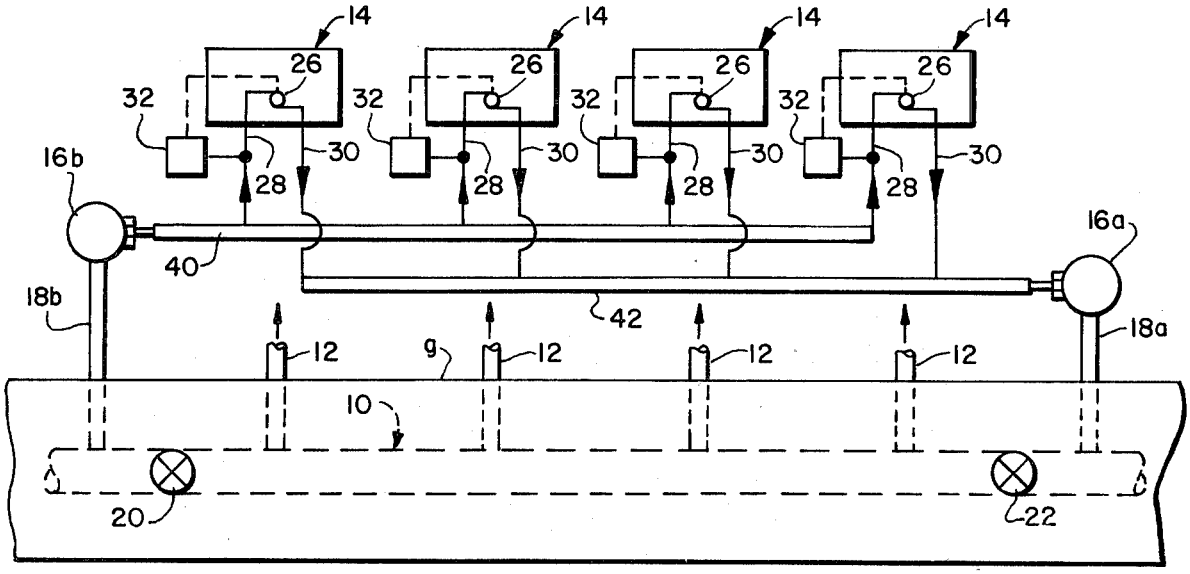
FIG. 2 is a view similar to FIG. 1 but depicting an alternate embodiment of the system of the present invention.

The embodiment of FIG. 2 contains a great majority of the same components as FIG. 1 which are given the same reference numerals. In accordance with the embodiment of FIG. 2, the valves 20 and 22 are located approximate to two hydrants 16*a* and 16*b*, respectively, which are connected to the water main 10 by the pipes 18*a* and 18*b* respectively. Assuming the hydrant 16*b* contains water at a slightly higher pressure than the hydrant 16*a*, the hydrant 16*b* would be connected to a temporary, overground supply pipe 40 and the hydrant 16*a* would be connected to a temporary, overground return pipe 42. Therefore, temporary water service would be provided by water flowing from the main 10 just outside the valve member 20 through the hydrant 16*b* and into the supply pipe 40 where it is circulated by the pump 20 through the pipes 28 and 30 and their respective locations 14 and back to the return pipe 42 under the control of the thermostat 32 as in the previous embodiment. It is thus seen that the system of the embodiment of FIG. 2 functions in essentially the same manner as that of FIG. 1.

It is understood that the pipes 40 and 42 can be provided with insulation and/or an external heater as needed as in the case of the previous embodiment.

Thus, according to each of the aforementioned embodiments, temporary water surface is provided between the disconnected portion of the water main and one or more locations remote to the water main by an overground pipeline system which is not as susceptible to water freezing as are conventional temporary systems.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A system for providing temporary water service between a water main and one or more locations normally connected to said main, said system comprising a pipeline located above ground and having a supply section and a return section, means connecting said pipeline to said main, pipe means for connecting each of said locations between said supply section and said return section into a closed loop and pump means responsive to the water temperature falling below a predetermined value for circulating said water from said supply section, through said location and to said return section, and said pump means generating a sufficient flow velocity to said water in said loop such that the friction developed due to flow velocity prevents the water from freezing.

2. The system of claim 1 wherein said means connecting said pipeline to said main comprises a hydrant, and pipe means connecting said hydrant to said main and to said pipeline.

3. The system of claim 1 wherein said circulating means further comprises a thermostat connected to said pump for controlling the operation of said pump in response to said water temperature in said pipe means falling below said predetermined value.

4. The system of claim 1 wherein said pipeline is formed into two separate, independent sections, one forming said supply and the other forming said return section.

5. The system of claim 4 wherein said means connecting said pipeline to said main comprises a first hydrant, a second hydrant, and means connecting said first and second hydrants to said supply section and said return section, respectively.

6. The system of claim 4 wherein said circulating means comprises a pipe means connecting said location between said supply section and said return section, and a pump for circulating said water.

7. The system of claim 6 wherein said circulating means further comprises a thermostat connected to said pump for controlling the operation of said pump in response to said water temperature in said pipe means falling below said predetermined value.

8. The system of claim 1 further comprising means for preventing the water in said pipeline from falling below a predetermined value.

* * * * *